US005338076A

United States Patent [19]

Tanaka

[11] Patent Number: 5,338,076

[45] Date of Patent: Aug. 16, 1994

[54] ACTUATOR DEVICE

[75] Inventor: Masaki Tanaka, Yokohama, Japan

[73] Assignee: Jidosha Denki Kogyo Kabushiki Kaisha, Yokohama, Japan

[21] Appl. No.: 31,943

[22] Filed: Mar. 16, 1993

[30] Foreign Application Priority Data

Mar. 17, 1992 [JP] Japan ..... 4-014173[U]

[51] Int. Cl.[5] ..... E05B 3/00

[52] U.S. Cl. ..... 292/336.3; 292/201

[58] Field of Search ..... 292/201, 336.3

[56] References Cited

U.S. PATENT DOCUMENTS

| | | | |
|---|---|---|---|
| 4,093,289 | 6/1978 | Inabayashi et al. | 292/336.3 |
| 4,270,783 | 6/1981 | Sorensen et al. | 292/336.3 |
| 4,573,723 | 3/1986 | Morita et al. | 292/336.3 |
| 4,779,912 | 10/1988 | Ikeda et al. | 292/336.3 |
| 4,793,640 | 12/1988 | Stewart, Sr. | 292/336.3 X |
| 4,885,954 | 12/1989 | Wanlass | 292/336.3 X |

FOREIGN PATENT DOCUMENTS

| | | |
|---|---|---|
| 064602 | 4/1982 | European Pat. Off. . |
| 810950 | 8/1951 | Fed. Rep. of Germany . |
| 60-59278 | 4/1985 | Japan . |
| 967093 | 8/1964 | United Kingdom . |

*Primary Examiner*—Rodney M. Lindsey

*Attorney, Agent, or Firm*—Sughrue, Mion, Zinn, Macpeak & Seas

[57] ABSTRACT

A door lock actuator device comprises a casing having a common mount for securing the casing to either one of right-handed door and left-handed door of an automotive vehicle. A cover element closes a side opening of the casing, and a motor is accommodated within the casing. A motion conversion means has input shaft connected to the motor, and serves to convert a rotary output motion of the motor into a rocking motion. The output shaft of the device has opposite end regions extending through, and protruding outwardly from the casing and the cover element, respectively, and a swing arm is connected to either one of the end regions of the output shaft. Standardized components are used to realize actuator device for right-handed doors and left-handed doors, to lower the manufacturing cost of the device and simplify the parts stock control.

3 Claims, 4 Drawing Sheets

ACTUATOR DEVICE

BACKGROUND OF THE INVENTION

1. Field of the Invention

The present invention relates to an actuator device; more particularly, it pertains to an actuator device used, for example, to perform a remote control of a door lock device for automotive vehicles.

2. Description of the Prior Art

One typical example of conventional actuator devices used to actuate a door lock device for automotive vehicles will be explained below with reference to FIG. 1. The illustrated actuator device is denoted generally by reference numeral 1, and includes a casing 2 with a side opening which is closed by a cover element 3. The casing 2 has an inside space accommodating therein a reversible motor 4, a reduction gear train 5 connected to the output shaft of the motor 4, and a sector gear 6 which is in mesh with an intermediate pinion 7 of the reduction gear train 5. The sector gear 6 is carried by a shaft 8 having one end region 8*a* which extends through, and projects outwardly from the casing 2. A swing arm 9 is fixedly secured to the end region 8*a* of the shaft 8, for example by caulking, and is adapted to be connected to a rod, not shown, with which the output force of the motor 4 is transmitted to the door lock device.

This type of actuator device has to be generally mounted within a narrow inner space of a side door of the vehicle, and it is thus necessary to realize a compact and space-saving arrangement of the device as a whole. Therefore, a known actuator device of this type typically includes as its output member a swing arm which undergoes a rocking motion on the outer surface of the casing on its rear side.

The above-mentioned known arrangement of the actuator device has conventionally been classified into two types, one for right-handed doors and another for left-handed doors. That is to say, due to the provision of the swing arm on the rear side of the casing, which is to be adopted to either a right-handed door or a left-handed door, it has been conventionally considered necessary to prepare the two types of the actuator device which are mirror-symmetrical to each other.

Generally, the two types of the actuator device have to be separately assembled at least partly with exclusive components which are not interchangeable and which thus cannot be used for a different type of the actuator device. This results in difficulties in standardizing the components for minimizing the types of the components, thereby to lower the manufacturing cost of the individual components and the total device, and also to simplify the parts stock control.

SUMMARY OF THE INVENTION

It is therefore a principal object of the present invention to provide an improved actuator device which is of a compact and space-saving arrangement, and which yet makes it readily possible to standardize the components such that a single type of component can be commonly used for both right-handed doors and left-handed doors of automotive vehicles.

Briefly stated, the present invention provides an actuator device which comprises a casing to be secured to a door of an automotive vehicle, for example, a cover element for closing a side opening of the casing, and a reversible motor accommodated within an inside space of the casing. A motion conversion means has an input shaft connected to the motor, and serves to convert a rotary output motion of the motor into a rocking motion. A swing arm is connected to an output shaft of the motion conversion means so that the rotary output motion of the motor causes the swing arm to undergo a rocking motion. The swing arm can be connected to an element which is to be actuated by the actuator device and associated with the door, for example, an input member of a door lock device.

According to the present invention, the casing has a common mount with which the casing can be secured to a selected one of right-handed door and left-handed door. The output shaft of the conversion means has opposite end regions which extend through, and protrude outwardly from the casing and the cover element, respectively. The swing arm is connected to selected one of the both end regions of the output shaft of the motion conversion means.

Therefore, in accordance with the present invention, when the actuator device is to be used for a right-handed door of automotive vehicles, for example, the swing arm is connected to one of the end regions of the output shaft of the conversion means, which is situated on one side of the casing. Conversely, when the actuator device is to be used for a left-handed door of automotive vehicles, the swing arm is connected to another one of the end regions of the output shaft of the conversion means, which is situated on another side of the casing.

This means that a single type of standardized component has an interchangeability for both right- and left-handed doors, and thereby allows the two types of actuator device to be readily manufactured with significantly improved productivity and minimized cost, and without complicated parts stock control.

Advantageously, the output shaft of the conversion means has an end region which is free from the swing arm and which is covered by a cap element. The cap element serves to positively prevent entry of foreign matters, such as dust or water, into the inside space of the casing to provide improved operational reliability and durability of the actuator device.

DESCRIPTION OF THE PREFERRED EMBODIMENT

The present invention will be explained in further detail hereinafter, with reference to one specific embodiment which is illustrated in FIGS. 2 to 6 of the accompanying drawings.

Figure 1:
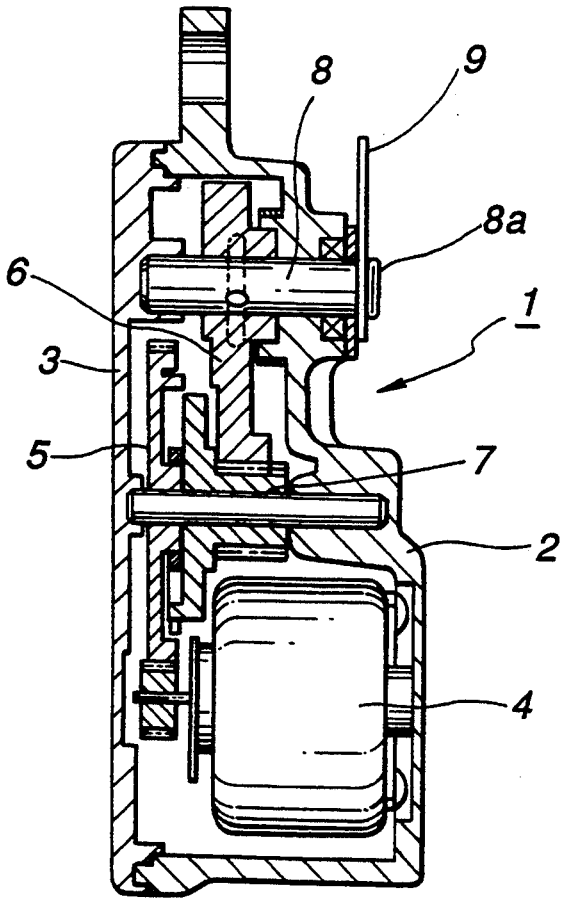
FIG.1 (PRIOR ART)
FIG. 1 is a longitudinal-sectional view showing the above-mentioned conventional actuator device.

The door lock actuator device in accordance with the present invention is generally denoted in FIGS. 2 to 6 by reference numeral 10. As in the conventional arrangement explained above with reference to FIG. 1, the actuator device 10 according to the present invention includes a casing 11 with a side opening which is closed by a cover element 12. The casing 11 has an inside space for accommodating therein a reversible electric motor 13, and a reduction gear train 14 connected to the shaft 13*a* of the motor 13. The motor 13 is fitted within a motor mount 11*b* formed inside of the casing 11. The gear train 14 is connected to the output shaft 15 of the actuator device 10, which serves to transmit the output motion of the motor 13 to an external device to be actuated by the actuator device 10. For this purpose, a swing arm 16 is arranged outside of the casing 11 and connected to the output shaft 15 of the actuator device 10.

Figure 3:
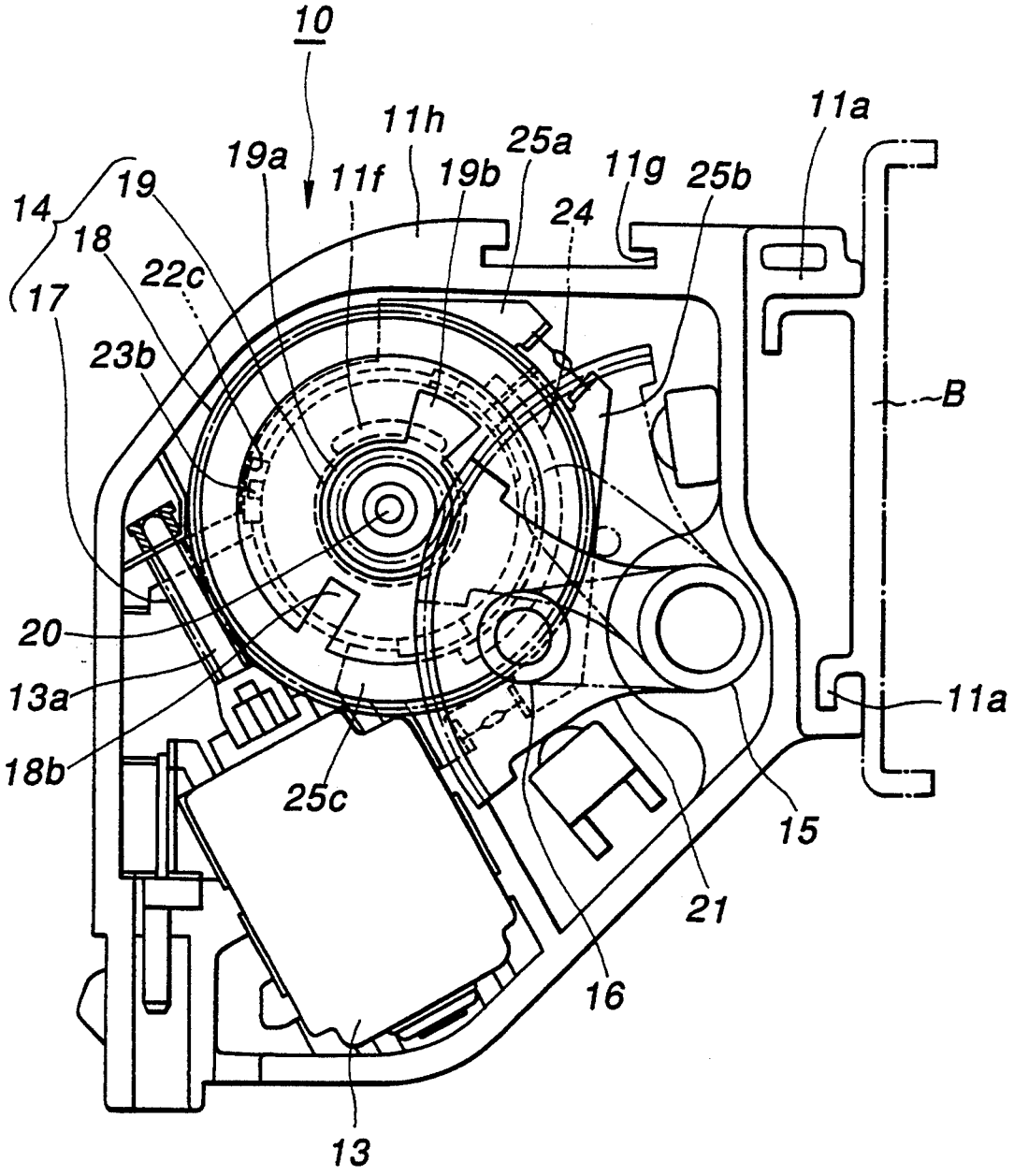
FIG. 3 is a side view showing the actuator device of FIG. 2, with the cover element removed from the casing.
Figure 4:
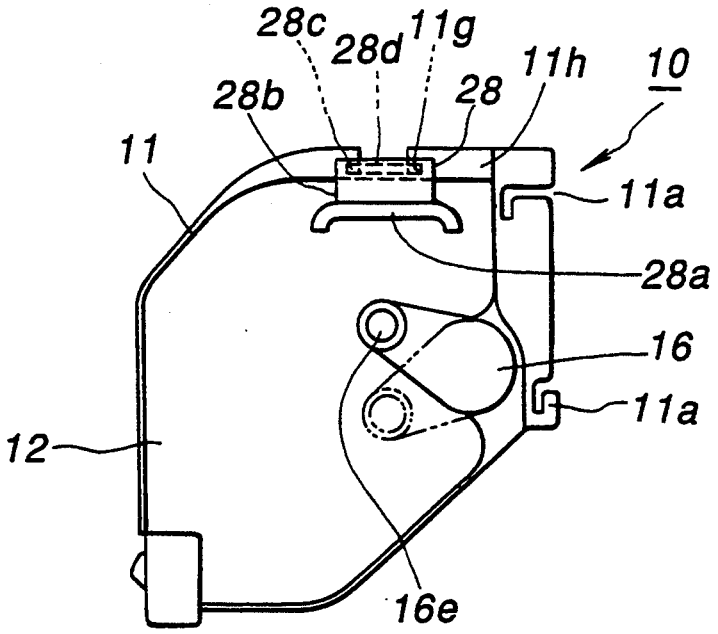
FIG. 4 is a side view showing the actuator device of FIG. 2, with the cover element secured to the casing.

As particularly shown in FIG. 4, the casing 11 is secured to a structural member of a door of an automotive vehicle, through a bracket B which forms part of the door and which is illustrated in FIG. 3 by imaginary line. Thus, the casing 11 has a pair of slits 11*a* which are arranged opposite to each other. These slits 11*a* are of substantially crank- or hook-like section, and are engageable with the bracket B irrespectively of whether the door is a right-handed door or a left-handed door. The slits 11*a* thus afford a common mount of the actuator device 10, which cooperates with the bracket B to secure the casing 11 to both types of the door.

Figure 2:
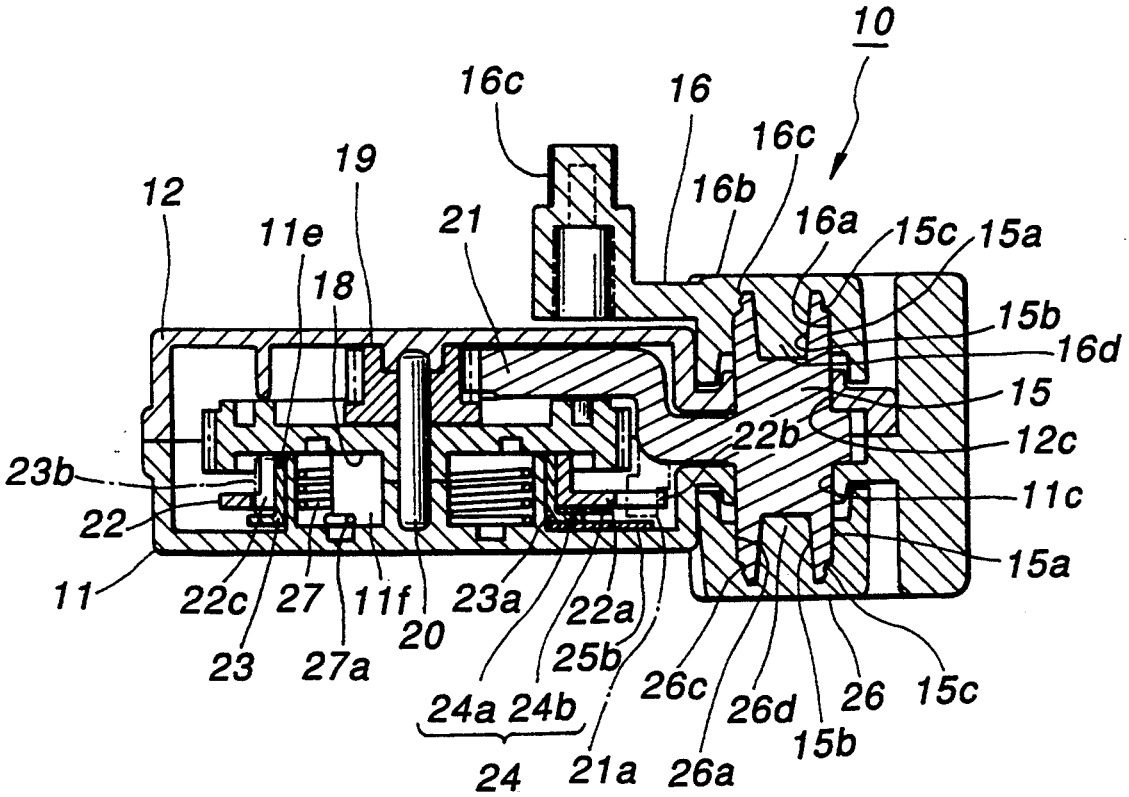
FIG. 2 is sectional view showing a door lock actuator device in accordance with one specific embodiment of the present invention, as seen from the bottom side.

The reduction gear train 14 includes a worm 17 which is carried by the motor shaft 13*a*, a worm wheel 18 which is in mesh with the worm 17, and a pinion 19 which is rotatable jointly with the worm wheel 18. The worm wheel 18 and the pinion 19 are carried by a common support shaft 20 which is journalled by, and extends between the casing 11 and the cover 12. The pinion 19 has a flange 19*a* in its axial end region, and this flange 19*a* is provided with a projection 19*b* which protrudes radially outwardly and extends locally circumferentially of the pinion 19. A similar projection 18*b* is formed on the inner surface of the worm wheel 18 at its annular outer peripheral region, which protrudes radially inwardly and extends locally circumferentially of the worm wheel 18. With reference to FIG. 2, the projection 19*b* is provided for the flange 19*a* on the end region of the pinion 19 on its lower side, and the projection 18*b* is provided on the upper surface of the worm wheel 18 in its central region. The pinion 19 is caused to rotate jointly with the worm wheel 18, when the projections 18*b*, 19*b* are brought into abutment with each other.

The output shaft 15 of the actuator device 10 is integrally provided with a sector gear 21 which is in mesh with the pinion 19 of the gear train 14. The output shaft 15 is rotatably journalled by bearing through-bores 11*c*, 12*c* formed in the walls of the casing 11 and the cover element 12, respectively. The output shaft 15 has both axial end regions 15*a* which extend outwardly beyond the casing 11 and the cover element 12 through the bores 11*c*, 12*c*, respectively. The end regions 15*a* of the output shaft 15 are formed with centering bores in the form of axial blind bores 15*b*, such that selected one of the two end regions 15*a* serves to connect the swing arm 16 in a practical use condition, as will be explained hereinafter. The end regions 15*a* of the output shaft 15 are further formed with circumferential recesses 15*c* on their outer peripheral surfaces.

The sector gear 21 has a radially inner region which is situated close to the output shaft 15, and which is provided with a pin 21*a* as shown by imaginary line in FIG. 2. The pin 21*a* projects in a direction which is in parallel with the axial direction of the output shaft 15, i.e. downwardly in FIG. 2. A substantially cylindrical contact holder 22 is arranged below the worm wheel 18 as seen in FIG. 2, and is caused to follow the movement of the sector gear 21 through the pin 21*a*. An annular wall 11*e* is formed on the inside bottom surface of the casing 11 coaxially to the support shaft 20. The contact holder 22 is fitted around the annular wall 11*e* with an insulating cylinder 23 therebetween. The contact holder 22 has a flange 22*a* in its lower end as seen in FIG. 2, having a lower surface which is provided with a contactor 24 constituted by a pair of arcuate contact pieces 24*a*, 24*b* which are aligned with each other. The flange 22*a* of the contact holder 22 has a local cutout 22*b* in which the pin 21*a* of the sector gear 21 is engaged. Three terminals 25*a*, 25*b*, 25*c* are arranged on the inside bottom surface of the casing 11 along the annular wall 11*e* . Thus, during the rotation of the output shaft 15, the contactor 24 together with the holder 22 is caused to sequentially move on the adjacent terminals 25*a*, 25*b*, 25*c*, thereby establishing contact or discontact between the contact pieces 24*a*, 24*b* and the terminals 25*a*, 25*b*, 25*c* so as to either activate or deactivate the motor 13.

The insulating cylinder 23 has an insulating piece 23*a* partly around its lower region as seen in FIG. 2, which is to be inserted between the contact piece 24*a* of the contactor 24 on the inner side, and a projection 23*b* protruding upwardly as shown by imaginary line in FIG. 2, which is arranged at a location substantially opposite to the insulating piece 23*a*. The flange 22*a* of the contact holder 22 has an elongate arcuate opening 22*c* which extends in the circumferential direction and in which the projection 23*b* of the insulating cylinder 23 is engaged. By this, the angular stroke range of the insulating cylinder 23 is made smaller than that of the contact holder 22. Thus, due to an angular stroke range of the insulating piece 23*a* which is smaller than that of the contact pieces 24*a*, 24*b* of the contactor 24, it is possible to shift the timing with which the contact pieces 24*a*, 24*b* are brought into contact with the terminals 25*a*, 25*b*, 25*c*, and out of contact therefrom so as to positively avoid occurence of undesirable chattering of the actuator device 10.

The swing arm 16 has a recess 16*a* in its boss 16*b*, which is fitted with the end region 15*a* of the output shaft 15, and an annular ridge 16*c* on the inner peripheral surface of the recess 16*a*, which corresponds to the circumferential recess 15*c* on the outer peripheral surface of the output shaft 15 at its end region 15*a*. Thus, the swing arm can be detachably secured to the output shaft 15 by engaging the end region 15*a* of the output shaft 15 with the recess 16*a* in the swing arm 16 while fitting the annular ridge 16*c* of the swing arm 16 into the circumferential recess 15*c* of the output shaft 15. In this connection, the recess 16*a* in the swing arm 16 is provided with an axial projection 16*d* of substantially frustoconical shape, which is fitted within and urged against the centering bore 15*b* of the end region 15*a* so as to prevent a free rotation of the swing arm 16 relative to the output shaft 15. The swing arm 16 has a free end 16*e* which can be connected to a rod (not shown), i.e. an input member of the door lock device.

Figure 6:
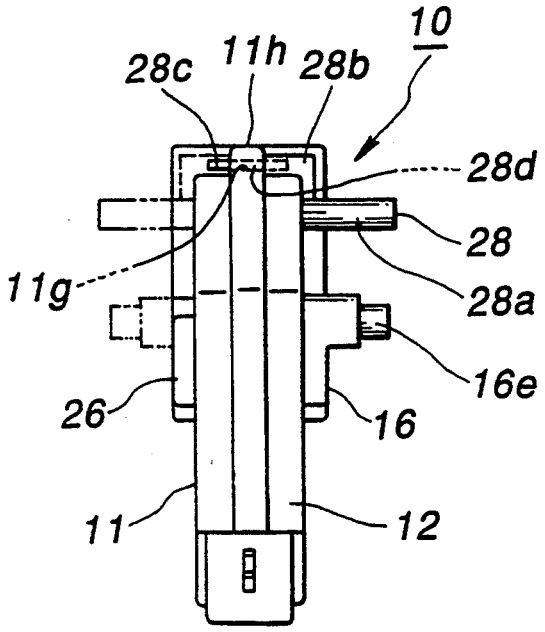
FIG. 6 is a front view showing the actuator device of FIG. 2.

In the illustrated embodiment, the swing arm 16 is secured to the end region 15*a* of the output shaft 15 which is situated on the upper side in FIG. 2 and on the right side in FIG. 6. Another end region 15*a* of the shaft 15, which is situated on the lower side in FIG. 2 and on the left side in FIG. 6, is covered by a cap element 26. The cap element 26 is similar to the boss 16*b* of the swing arm 16 in that it includes a recess 26*a* which is fitted with the end region 15*a* of the output shaft 15, an annular ridge 26*c* on the inner peripheral surface of the recess 26*a*, which corresponds to the circumferential recess 15*c* on the outer peripheral surface of the output shaft 15 at its end region 15*a*, and an axial projection 26*d* of substantially frustoconical shape, which is fitted within and urged against the centering bore 15*b* of the end region 15*a*. The cap element 26 serves to positively prevent entry of foreign matters, such as dust or water, into the inside space of the casing 11 to provide improved operational reliability and durability of the actuator device 10.

The illustrated embodiment of the actuator device 10 further includes a return mechanism formed of a coil spring 27 provided inside of the annular wall 11*e* of the casing 11. One hook-like end 27*a* of the coil spring 27 is engaged with and retained by a retainer 11*f* formed in the bottom surface of the casing 11 inside of the annular wall 11*e*, and another end of the coil spring 27 is engaged with and retained by a retainer (not shown) which is provided for the worm wheel 18 in its lower surface as seen in FIG. 2. Thus, whenever the worm wheel 18 is caused to rotate either clockwise or counterclockwise in FIG. 3, the worm wheel 18 is returned to its initial position by the restoring force of the coil spring 27 as soon as the motor 13 is stopped.

Figure 5:
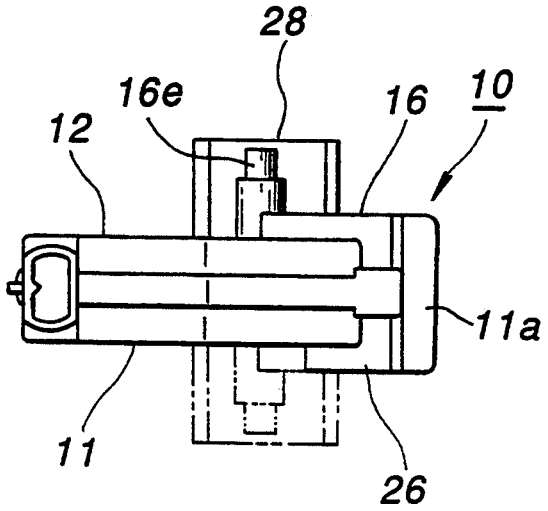
FIG. 5 is a bottom view showing the actuator device of FIG. 2.

The illustrated embodiment of the actuator device 10 further includes, as particularly shown in FIGS. 4 to 6, an anti-theft cover element 28. The cover element 28 includes a cover portion 28*a* which covers an upper side of the swing arm 16 such that wires or the like, which may be inserted into a space between the door panel and associated window pane, can be prevented from reaching the swing arm 16. A support portion 28*b* is provided on the edge of the cover portion 28*a*, and an insertion portion 28*c* is projected from the support portion 28*b* in a direction opposite to the cover portion 28*a* and provided with a free end in the form of a catch 28*d*. The cover element 28 can be secured to the casing 11 by inserting the insertion portion 28*c* from one side, i.e. from right side in FIG. 6, into a groove 11*g* formed in a thin walled portion 11*h* at the upper end of the casing 11, and further engaging the catch 28*d* with the surface of the thin walled portion 11*h* on another side, i.e. on the left side in FIG. 6.

In this connection, the upper extension of the support portion 28*b* of the cover element 28 is preferably bent so that the thin walled portion 11*h* of the casing 11 can be situated substantially at the longitudinal center of the upper extension of the support portion 28*b*. This makes it possible to secure the cover element 28 to the casing 11 with a symmetrical orientation, when the swing arm 16 is to be secured to another end region 15*a* of the output shaft 15 as shown by imaginary line in FIGS. 4 to 6.

The actuator device 10 in accordance with the present invention can be secured to the bracket B of a door irrespectively of whether the door is a right-handed door or a left-handed door, and the swing arm 16 can be secured to either one of the two end regions 15*a* of the output shaft 15. It is therefore unnecessary to classify the actuator device into two types, one for right-handed doors and another for left-handed doors. Since the components can be standardized and the type of the components can be minimized, it is readily possible to lower the manufacturing cost of the individual components and the total device, and to simplify the parts stock control.

In operation of the door lock actuator device 10, when the door lock is in a lock-off state corresponding to the state of the actuator device 10 as shown by imaginary line in FIG. 3, the motor 13 is supplied with electric power from an external power source and is caused to rotate in the normal direction. This rotation is transmitted to the worm wheel 18 via the worm 17, so that the worm wheel 18 is caused to rotate clockwise.

Subsequently, when the projection 18*b* of the worm wheel 18 comes into abutment with the projection 19*b* of the pinion 19, the pinion 19 begins to rotate clockwise, jointly with the worm wheel 18. By this, the pinion 19 in mesh with the sector gear 21 causes the output shaft 15 to rotate counterclockwise so that the swing arm 16 secured to the end region 15*a* of the output shaft 15 begins to rotate also counterclockwise.

In response to the rotation of the output shaft 15, the contact holder 22 is caused to rotate clockwise and the supply of electric power to the motor 13 is stopped as soon as the contactor 24 is disconnected from the terminal 25*a*, and is connected to the terminals 25*b*, 25*c*. On this instance, the swing arm 16 assumes a position as shown by solid line in FIG. 3, wherein the door lock device has been switched into a lock-on state via the input rod, not shown.

During this operation of the actuator device 10, the insulating cylinder 23 is caused to rotate over an angular range which is smaller than that for the contact holder 22, and the insulating piece 23*a* of the insulating cylinder 23 is caused to move with a slight lag with reference to the contact piece 24*a* on the inner side. Thus, it becomes possible to shift the timing with which the contact pieces 24*a*, 24*b* are brought into contact with the terminals 25*a*, 25*b*, 25*c*, and out of contact therefrom so as to positively avoid occurence of undesirable chattering of the actuator device 10.

Moreover, since the retainer for the coil spring 27 which is provided for the worm wheel 18 is spaced from the retainer 11*f* provided for the casing 11 to generate a restoring force of the coil spring 27, so that only the worm wheel 18 is caused to return to the initial position as soon as the motor 13 is stopped.

In this condition, by supplying the electric power to the motor 13 to cause the motor 13 to rotate in the reverse direction, the worm wheel 18 and the pinion 19 are caused to rotate in the opposite direction so that the output shaft 15 and the swing arm 16 are cased to rotate in the opposite direction to reach the position illustrated in FIG. 3 by imaginary line, wherein the door lock device assumes a lock-off state.

It will be readily appreciated from the foregoing detailed description that the present invention provides an improved actuator device which is of a compact and space-saving arrangement, and which yet makes it readily possible to standardize the components such that a single type of components can be used for both right-handed doors and left-handed doors of vehicles.

While the present invention has been explained with reference to a specific embodiment, such explanation has been presented by way of example only. It is of course possible that various modifications and/or alterations may be made without departing from the scope of the invention which is as defined in the appended claims. For example, the sector gear 21 may be prepared separately from the output shaft 15 and then integrally connected therewith.

What is claimed is:

1. An actuator device comprising:

a casing to be secured to a door, said casing having an inside space and a side opening on one side thereof;

a cover element for closing the side opening of the casing;

a reversible motor accommodated within the inside space of the casing;

a motion conversion means for converting a rotary output motion of the motor into a rocking motion, said motion conversion means having an input shaft connected to the motor, and an output shaft;

a swing arm connected to the output shaft of the motion conversion means so that the rotary output motion of the motor causes the swing arm to undergo a rocking motion, said swing arm being adapted to be connected to an element to be actuated by the actuator device and associated with the door;

said casing having a common mount with which the casing can be secured to a selected one of a right-handed door and a left-handed door;

said output shaft of the motion conversion means having opposite end regions which extend through, and protrude outwardly from said casing and said cover element, respectively, said swing arm being connected to a selected one of the opposite end regions of said output shaft of the motion conversion means; and a cap element for covering another one of the opposite end regions of the output shaft of the conversion means, which is free from said swing arm.

2. A door lock actuator for use in an electric door lock system with a door-lock mechanism of a vehicle with right-handed and left-handed doors, each having an identical bracket to which the actuator is to be secured comprising:

a casing having a common mounting means for securement to one of said brackets and being provided with an inside space, a side opening on one side thereof and a first bore passing through an opposite side of said casing;

a cover element for closing the side opening of said casing and provided with a second bore disposed opposite the first bore of said casing;

a reversible motor mounted within the inside space of said casing;

a motion conversion means mounted in said casing for converting a rotary output motion of said motor into a rocking motion, said motion conversion means having an input shaft connected to said reversible motor and an output shaft having first and second end portions rotatably journalled by bearing means through said first and second bores of said casing and said cover and extending outwardly beyond said casing and said cover; and a swing arm that can be connected to either one of the first and second end portions of the output shaft of said motion conversion means, said swing arm being adapted to actuate the door lock mechanism.

3. The door lock actuator of claim 2, said actuator further comprising a cap element for covering another one of the first and second end portions of the output shaft of said motion conversion means.

* * * * *